US006980124B2

(12) United States Patent
Kong et al.

(10) Patent No.: US 6,980,124 B2
(45) Date of Patent: Dec. 27, 2005

(54) WIRELESS SECURITY, TELEMETRY AND CONTROL SYSTEM

(75) Inventors: Qin Kong, San Diego, CA (US); Frank Stevens, Naperville, IL (US)

(73) Assignee: Autosafe International, Inc., West Palm Beach, FL (US)

( * ) Notice: Subject to any disclaimer, the term of this patent is extended or adjusted under 35 U.S.C. 154(b) by 26 days.

(21) Appl. No.: 10/621,235

(22) Filed: Jul. 15, 2003

(65) Prior Publication Data

US 2005/0012640 A1 Jan. 20, 2005

(51) Int. Cl.[7] ..... G08C 19/04

(52) U.S. Cl. ..... 340/870.11; 340/870.07; 340/539.19; 340/426.11; 340/426.12; 340/426.16; 701/22; 701/33; 701/44

(58) Field of Search ..... 701/22, 33, 44; 340/539.19, 426.16, 426.11, 426.12, 870.11, 340/870.07

(56) References Cited

U.S. PATENT DOCUMENTS

| | | | | |
|---|---|---|---|---|
| 4,383,242 | A | 5/1983 | Sassover et al. | |
| 4,754,255 | A | 6/1988 | Sanders et al. | |
| 5,049,867 | A | 9/1991 | Stouffer | |
| 5,146,215 | A | 9/1992 | Drori | |
| 5,473,200 | A | 12/1995 | Woo | |
| 5,990,785 | A | 11/1999 | Suda | |
| 6,262,656 | B1 | 7/2001 | Byrd et al. | |
| 6,469,638 | B1 * | 10/2002 | Johnson | 340/870.16 |
| 6,670,890 | B2 * | 12/2003 | Kyrtsos et al. | 340/870.17 |
| 6,738,697 | B2 * | 5/2004 | Breed | 701/29 |
| 6,741,174 | B2 * | 5/2004 | Rhoades et al. | 340/540 |
| 6,832,251 | B1 * | 12/2004 | Gelvin et al. | 709/224 |

* cited by examiner

*Primary Examiner*—Albert K. Wong
(74) *Attorney, Agent, or Firm*—McHale & Slavin, P.A.

(57) ABSTRACT

The present invention relates to a security, telemetry and control system which utilizes wireless communication between a control unit and smart relay(s) within the vehicle and also utilizes wireless communication between the vehicle and a remote base station to monitor and protect a vehicle or piece of equipment against unauthorized users and thieves.

37 Claims, 3 Drawing Sheets

WIRELESS SECURITY, TELEMETRY AND CONTROL SYSTEM

FIELD OF THE INVENTION

This invention relates to a combination security, telemetry and control system for mobile equipment such as vehicles, construction machinery, agricultural equipment or material handling units. A vehicle mounted main control unit provides wireless bi-directional communication with smart relays located within the vehicle and a remote base/control station located outside of the vehicle.

BACKGROUND OF THE INVENTION

Theft and unauthorized use of mobile pieces of equipment such as motor vehicles, construction equipment, aircraft and the like is widespread. Vehicle security systems are widely used to deter vehicle theft and vandalism, prevent theft of valuables from a vehicle, and to protect vehicle owners and occupants. A typical automobile security system includes a central processor unit (CPU) or controller connected by wire to a plurality of vehicle sensors. Typical sensors that monitor the vehicle may detect opening of the trunk, hood doors or windows. Other common sensors such as ultrasonic and microwave motion detectors, vibration sensors, sound discriminators, and differential pressure sensors may detect movement of the vehicle or within the vehicle. Still other sensors such as radar sensors may be used to monitor the area proximate to the vehicle. Any number of these sensors may be hard wired to the controller unit and may trigger the alarm when a thief violates a protected area.

A vehicle security system may also include a passive arming feature wherein the status of all trigger inputs are automatically monitored when the ignition switch is turned off. Normal arming occurs after expiration of an exit delay. U.S. Pat. No. 4,754,255 to Sanders et al. discloses a variation of passive arming wherein any unsecured zone is monitored when the ignition key is turned off.

Although numerous devices are well known, they have generally met with limited success and share numerous weaknesses. For most alarm systems, it is desirable to hide the location of the controller and sensors to prevent a thief from discerning their location and defeating their operation. Unfortunately, installation of the prior art devices generally require installers to run new wiring. Extra wiring is a tell tale sign to thieves that a security system is being employed. The extra wiring also provides a weak link in the alarm system, giving away the controller and sensor hiding places which are easily disabled by cutting the wires that connect the system.

When a vehicle sensor is triggered, the security systems currently available typically operate to give an alarm indication. The alarm indication may be a flashing of the lights and/or the sounding of a horn or a siren. In addition, the vehicle fuel supply and/or ignition power may be selectively disabled based upon the alarm condition.

Unfortunately, flashing lights, horns, and sirens are extremely common today and rarely provide an efficient deterrent to thieves. Radio signaling systems are likewise ineffective because they rely on the speed and efficiency of local police departments. Many police departments are understaffed and unable to respond before a thief can gain enough knowledge about an alarm system to disable it.

In an attempt to eliminate the tell tale extra wiring, other alarm systems utilize the existing vehicle wiring harness. A system that connects to the existing wiring harness and on-board computer system is disclosed in U.S. Pat. No. 5,473,200. These systems have also proven to be ineffective and obvious to more sophisticated thieves with access to electronic equipment. Today most vehicles and/or engine equipped machinery have a self-diagnosing control system or on-board computer. When starting the vehicle the on-board computer checks to see that all critical systems are operational. If a system is not functioning properly a warning light or signal is activated to alert the operator of the non-functioning system. For example, if a security system disables the fuel circuit the on-board computer will illuminate a dash light and store a code in the computer. Knowledge about the system can be easily gained visually or with equipment such as an engine scanner, which a thief can use to disable the alarm system.

It is also known to provide remote communication with certain operable circuits or functional elements of a vehicle through the security system. A typical security system of this type includes a receiver associated with the controller that cooperates with a remote transmitter such as an electronic key fob carried by the user, such as those disclosed in U.S. Pat. No. 4,383,242 to Sassover et al., and U.S. Pat. No. 5,049,867 to Stoufer, and U.S. Pat. No. 5,146,215 to Drori. The remote transmitter may be used to arm and disarm the controller in the vehicle or provide other remote control features from a predetermined range directly outside the vehicle. The controller may contain features to store and compare unique codes associated with a plurality of remote transmitters, each remote transmitter having its own unique code initially programmed therein. Transmitter codes may be added or deleted from the controller corresponding to the number of remote transmitters desired by the user. Unfortunately, a thief may use a signal scanner to gain access to the controller and readily install the code of an unauthorized remote transmitter. The owner would thus be unaware of such activity, until the thief returns with the unauthorized remote transmitter to disarm the security system and steal the vehicle.

U.S. Pat. Nos. 5,990,785 and 6,262,656 disclose security systems that are capable of disabling a vehicle using pager networks or cell phones. However, these systems suffer from some of the same shortcomings as those discussed above. The controllers require hardwiring throughout the vehicle, allowing a sophisticated thief to cut wires to disable the system. Moreover, the systems do not transmit a tracer signal when the vehicle is stolen or utilize monitoring from a base station. To disable the vehicle the owner must know the vehicle has been stolen and be physically able to call the system to input the code which initiates the disabling sequence. These systems are inadequate for vehicles parked in remote areas not driven daily as days may pass before the owner would realize the vehicle was missing. Moreover, these systems do not provide any method of monitoring temperatures, pressures, loads or speeds from a base station during normal vehicle operation.

The aforementioned problems with known security systems are exacerbated when used on expensive heavy construction machinery and agricultural equipment that often remains in very remote areas for extended periods of time. The high value and remote location of the equipment increase the likelihood of theft and make it impossible to monitor a typical flashing light and siren alarm. Even if alerted, police may find it difficult or impossible to locate or gain access to the equipment before a thief can abscond with it. Typical alarms alert the thief, giving him time to escape from the area before the authorities can get there. Some thieves may return multiple times with different electrical equipment or strategy attempting to bypass or disable the system.

In addition to preventing theft of their equipment, some equipment owners or businesses may want to monitor the normal usage and operating condition of their equipment from a base station using wireless communication. Prior art security systems generally do not offer the ability to telemeter such items as pressures, temperatures and speeds related to the equipment. It would also be beneficial for vehicle owners to control functions such as locking, unlocking, disabling and starting of this equipment from the base station using wireless communication. Accordingly there has been a long felt need in the art for a combination security, telemetry and control system which provides an efficient deterrent to crime as well as providing valuable information to equipment owners.

SUMMARY OF THE INVENTION

In view of the foregoing background, it is an objective of the present invention to provide a security system which utilizes-wireless communication between a control unit and smart relay(s) to protect a vehicle, or piece of equipment, against unauthorized users and thieves.

It is a further objective of the present invention to provide a security system which utilizes wireless communication between a control unit and smart relay(s) that is hidden from vehicle diagnostic equipment.

It is another objective of the present invention to provide a security system which utilizes wireless communication between a control unit and smart relay(s) capable of sending out a tracer signal in the event the protected vehicle or heavy equipment is tampered with.

It is yet another objective of the present invention to provide a security system which utilizes wireless communication between a control unit and a remote base station which allows the vehicle or equipment to be monitored from remote locations via wireless networks.

It is a further objective of the present invention to provide a security system kit which is simple to install and suited for original equipment and after market installations on mobile vehicles and heavy equipment.

Yet another objective of the present invention is to provide a security system kit which is inexpensive to manufacture and which is simple and reliable in operation.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

In one embodiment of the instant invention the system utilizes a wireless communication network between the main control unit (MCU) and smart relays to replace the conventional hard-wired controller and sensor systems of the prior art. The instant invention also provides a reporting alarm, telemetry and control system which utilizes a two-way paging device and/or a two way cellular data modem to communicate between the main control unit and a remote base monitoring station. Equipment such as mobile vehicles, construction machinery, agricultural equipment or material handling units incorporate the MCU and at least one smart relay in wireless communication with the MCU for indicating an alarm condition or monitoring vehicular parameters. The MCU includes at least one receiver for receiving commands from the base station via the two-way pager or cellular date modem devices and may include an optional RF, low frequency or infra red receiver for checking the user ID and receiving information from the smart relay(s). The user ID may be checked via the wireless two-way pager device or a programmable electronic key which transmits the user ID to a surface mounted receiver. The MCU collects and processes various alarm conditions and/or vehicular operating data via sensors incorporated into the smart relay(s) which can be stored in memory or transmitted to the remote base station via the 2-way paging or cellular device. For example sensors are available for incorporation into the smart relay for monitoring operating characteristics such as temperature, pressure, load monitoring, flow rates, speeds, electrical system status, servicing needs, as well as alarm conditions such as opening of the trunk, hood, doors and windows. Movement of the vehicle, within the vehicle or around the vehicle may also be monitored using ultrasonic and microwave motion detectors, vibration sensors, sound discriminators, differential pressure sensors, and radar sensors. The data transferred to the remote monitoring station can be further analyzed and statistically compared to trend data to further ascertain the condition and operating parameters of the equipment. Upon receipt of anomalous data or an alarm condition from a smart relay, the base station can transmit commands back to the MCU. The MCU includes at least one transmitter for transmitting commands to the smart relay(s). Such commands would permit the base station to remotely control or alter functions of the vehicle and the security system; for example, allowing the vehicle to start without the proper ID key, controlling fuel supplied to the engine, shutting down the equipment or specific systems.

Accordingly, an existing low-cost bi-directional pager and/or cellular transmission network can be utilized. Whereas prior paging technology only allowed for one-way paging, current two-way pager systems allow transmissions to be sent in both directions between the base station and the MCU. Known communication protocols and data structures can be used to facilitate the organization and transmission of data and/or commands. The two-way pager device and related protocol might include any of several systems currently on the market. For example, Motorola's Advanced Messaging Systems Division (AMSD) and Destineer Corporation, which is a subsidiary of Mobile Telecommunication Technologies Corp. (Mtel), provide a nationwide ReFlex.TM system.

DETAILED DESCRIPTION OF THE INVENTION

Although the invention is described in terms of a preferred specific embodiment, it will be readily apparent to those skilled in this art that various modifications, rearrangements and substitutions can be made without departing from the spirit of the invention. The scope of the invention is defined by the claims appended hereto.

Figure 1:
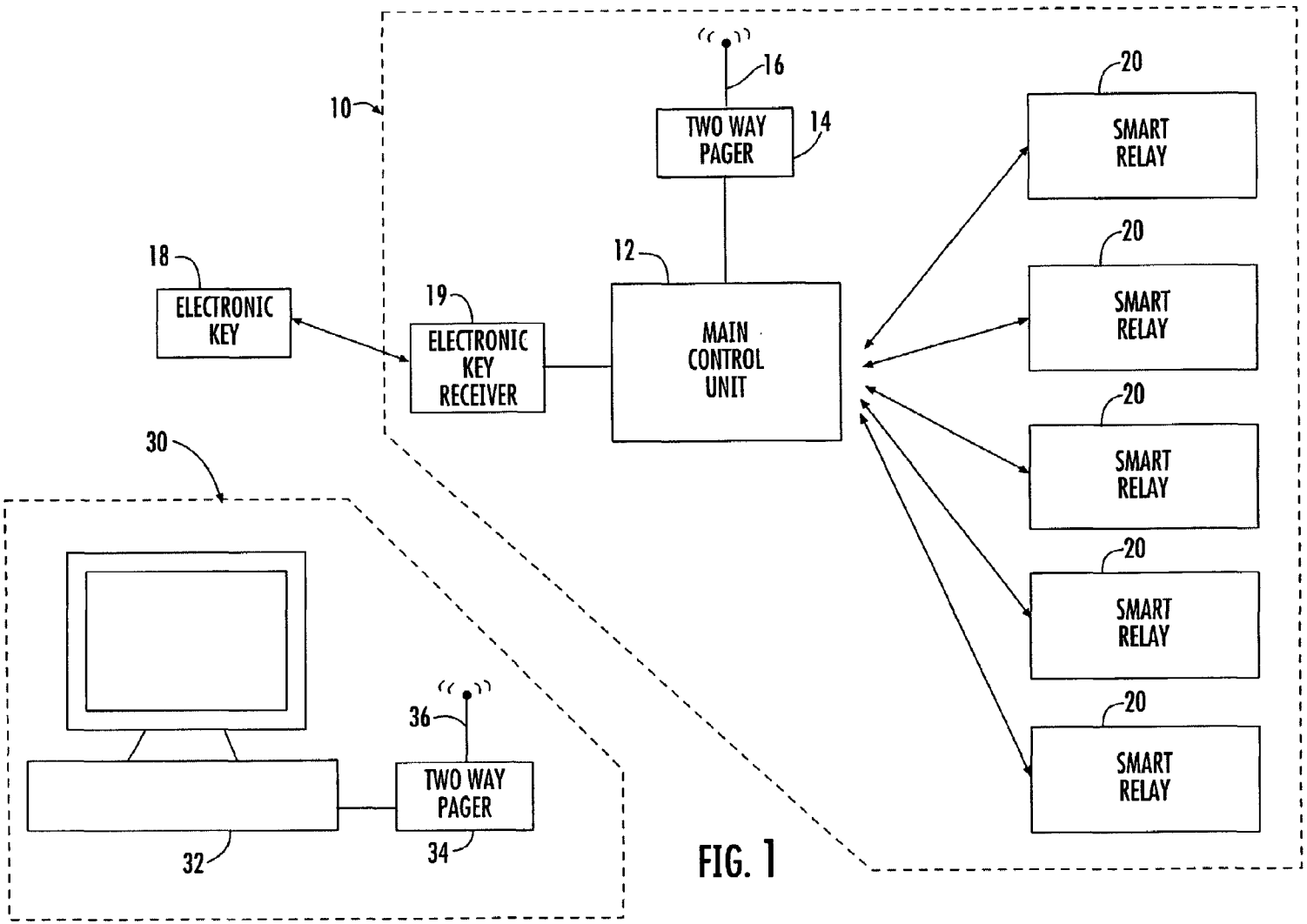
FIG. 1 is a block diagram of a security system utilizing the two-way paging device to communicate between a vehicle and a base station.

Referring to FIG. 1, a block diagram of the instant invention is shown illustrating the preferred system 10 which would be installed into a piece of mobile equipment, e.g. vehicle, construction machinery, farm equipment, airplane, boat, material handling equipment and the like, and linked via a wireless two-way pager and/or cellular connection to a remote base monitoring station 30. The equipment is protected by the security system 10 which incorporates the two-way paging device 14 in the security system main control unit 12. The base monitoring station 30 utilizes a computer 32 coupled to a similar two-way paging transmitter/receiver 34. During normal operation or an alarm situation within the vehicle, coded transmissions emanate from the respective antenna 16 which is electrically connected to the two-way paging device 14. The coded messages are received by the base station antenna 36 which is electrically connected to the base two-way paging device 34. The messages may be read directly from the two-way pager device 34 or they may be input into the computer 32 for storage or further analysis. As described above the two-way pager system might include hardware and related protocol software from any of a variety of manufacturers. The preferred embodiment presented herein utilizes the ReFlex.TM communication protocol for its functionality.

The MCU 12 includes a wireless transmitter and receiver for communicating with at least one smart relay which monitors and/or controls some parameter of the vehicle. The transmitter and receiver may be an RF, low frequency or infra-red type or a suitable combination thereof. The wireless communication between the main control unit 12 and the smart relay(s) 20 of the system allow the components to be discretely hidden within the vehicle without tell-tale wiring and at locations unfamiliar to thieves.

The MCU 12 also includes a means of establishing a user ID which is preferably a combination electronic key 18 and a electronic key receiver 19. The electronic key 18 has a unique and unalterable address laser etched onto the chip which can be used as an identifier for each key. The features available to each of the electronic keys 18 are programmable with a PC, a laptop or a hand held computer to enable or disable any number of functions within the equipment configured with a smart relay 20. The key 18 can be of the read only memory (ROM) type which allows the key to be programmed only once, or they can have a re-programmable type memory allowing the key to be reprogrammed to accept additional equipment or functions. The electronic key 18 can also be programmed to control the hours of operation for a piece of equipment or to allow operation of numerous types and/or pieces of equipment with a single electronic key. The key receiver 19 is also programmable to accept a plurality of electronic keys 18, and in the preferred embodiment should accept about twenty different keys. Each key 18 is operable to control any number of the available features or functions associated with the piece of mobile equipment. Such an electronic key is currently sold under the name iButton by Maxim/Dallas Semiconductor Corporation. It is also understood that other suitable electronic key devices such as magnetic strips, computer chips and key fobs, as well as combinations thereof could be utilized to establish a user ID with the MCU 12.

Referring again to FIG. 1, and operation of the preferred embodiment of the instant invention. The operator turns on the ignition key and thereafter establishes a user ID by touching his electronic key 18 to the electronic key receiver 19 in electrical communication with the MCU 12. The user ID code is transferred from the electronic key 18 to the MCU 12 via the key receiver 19. The MCU 12 thereafter enables the functions of the mobile piece of equipment permitted by the user ID. If the ID code is correct the MCU 12 transmits the "allow start" command to the smart relay 20 to permit the vehicle or heavy equipment to start. In the event that an operator loses an electronic key 18 or someone needs to operate a piece of equipment that does not have an electronic key 18, the base station 32 can utilize the two-way pager or cellular device 34 to enable the system 10 and allow the equipment to operate. If no electronic key is used or the incorrect electronic key is touched to the receiver 19 the MCU 12 can be programmed to disable functions such as starting or fuel supply, or enable functions such as sending an alert or tracer signal to the base station 32 or activating a siren and lights (not shown).

Figure 2:
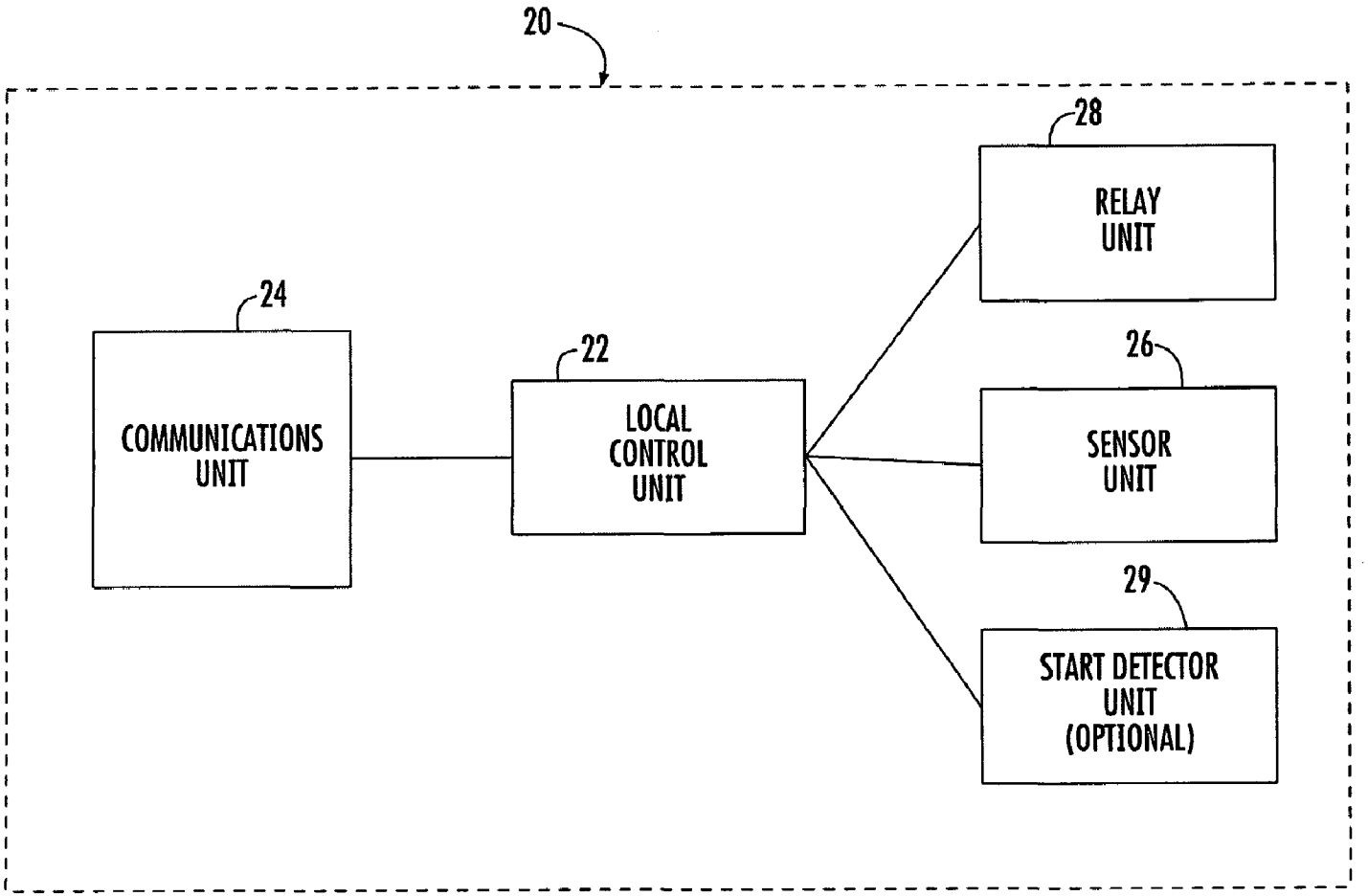
FIG. 2 is a block diagram of the wireless smart relay of the instant invention.

Referring now to FIG. 2, a more detailed block diagram of the wireless smart relay 20 is shown. The smart relay includes three basic components: the local control unit (LCU) 22, the communication unit 24, and a relay unit 28 and may include a sensing unit 26 and/or a start detector unit 29 as optional components.

The LCU 22 coordinates the various functions and modes of the smart relay components to allow the smart relay 20 to function as a single unit in communication with and controlled by the MCU 12.

The communications unit 24 is constructed and arranged for wireless communication with the MCU 12. The communications unit 24 includes an RF, low frequency or infrared receiver for receiving wireless commands from the MCU 12 and may also include an optional RF, low frequency or infrared transmitter to send information collected by the smart relay 20 back to the MCU 12 when required.

The optional sensing unit 26 is constructed and arranged to monitor a variety of items related to the equipment which may include but should not be limited to electrical system status, speed, temperature, fluid levels, pressures, flows, service needs, opening of the trunk, hood, doors, windows, and also movement of the vehicle or within and around the vehicle utilizing ultrasonic and microwave motion detectors vibration, sound discriminators, differential pressure, and radar. The sensing unit 26 uses state of the art analog or digital sensors and communicates the information back to the LCU 22 in a digital format.

The relay unit 28 is constructed and arranged to shut down or turn on functions within the vehicle. The relay unit 28 may be either normally open or normally closed based on commands from the LCU 22. This construction allows the smart relay 20 to control the starter, fuel and other vehicular circuits while remaining undetectable by automotive scanners and diagnostic equipment, including the on-board computer as will be discussed further.

The optional start detector unit 29 is constructed and arranged to monitor the current operating parameters of the mobile vehicle. This includes monitoring the vehicle for attempted starts as well as preventing a function or system from shutting down at an inopportune time and causing an unsafe condition. If an alarm condition is established by either the sensing unit 26 or the remote base station 30 the LCU 22 will communicate with the start detector 29 to determine is a safe condition exists to complete shut down of that function or system. For example, this arrangement can prevent vehicle systems from being shut down when they are under a load or operating at high speeds, thereby insuring the safety of the operator.

The four basic components of the smart relay 20 are capable of operation in three different modes; basic, smart and sensing. In the basic mode, the LCU maintains the relay unit 28 in the normally open position. For example, if the relay unit is incorporated into the starter circuit of the vehicle the equipment will not start until the MCU 12 sends an "allow start" signal to the LCU 22 and the LCU 22 closes the relay 28.

In the smart mode, the LCU 22 maintains the relay 28 in the normally closed position wherein the functions of the vehicle will attempt to start normally. When the relay unit 28 is in the smart mode the optional start detector 29 monitors the vehicle for attempted starts. Upon a sensed attempted start the LCU 22 will automatically open the relay, preventing the start, unless the MCU 12 transmits a "close the relay" command to the LCU after checking the user ID. If the MCU 12 returns the "close the relay" command the relay remains closed and the vehicle function is allowed to start. If the wrong code is returned the relay 28 is opened, thereby preventing the function from completing the starting cycle. If the wrong user ID code is found the MCU 12 may utilize the two-way pager or cellular device 14 to send an alarm code to the base station 30. Thereafter, the base station 30 may send codes back to the MCU 12 to disable specific functions of the vehicle, or the base could return an allow function code to enable the vehicle function. In this mode the smart relay 20 is hidden from diagnostic equipment and the on-board computer. The relay unit 28 operates to disable the vehicle function only during the attempted start and returns the system to normal as soon as the ignition key is released. This prevents an error code from being established within the vehicles on-board computer or any external diagnostic equipment which may be attached to the vehicle, thereby hiding the security system.

In the sensing mode the sensor unit 26 can be utilized to monitor a variety of functions inside or outside of the vehicle. Information suitably collectable by state of the art sensors may include but should not be limited to temperature, pressure, load monitoring, flow rates, speeds, electrical system status, as well as alarm conditions such as opening of the trunk, hood, doors and windows. Movement of the vehicle, within the vehicle or around the vehicle may also be monitored using ultrasonic and microwave motion detectors, vibration sensors, sound discriminators, differential pressure sensors, and radar sensors. The measured data is transferred digitally to the LCU 22 which transmits the monitored data to the MCU 12 via the communication unit 24. The MCU 12 may be configured to store and/or optionally transmit the monitored information to the base station via the 2-way pager 14. At the remote base station 30 the information can be further analyzed on a computer 32 and statistically compared to trend data to further ascertain the condition and/or status of the equipment.

Figure 3:
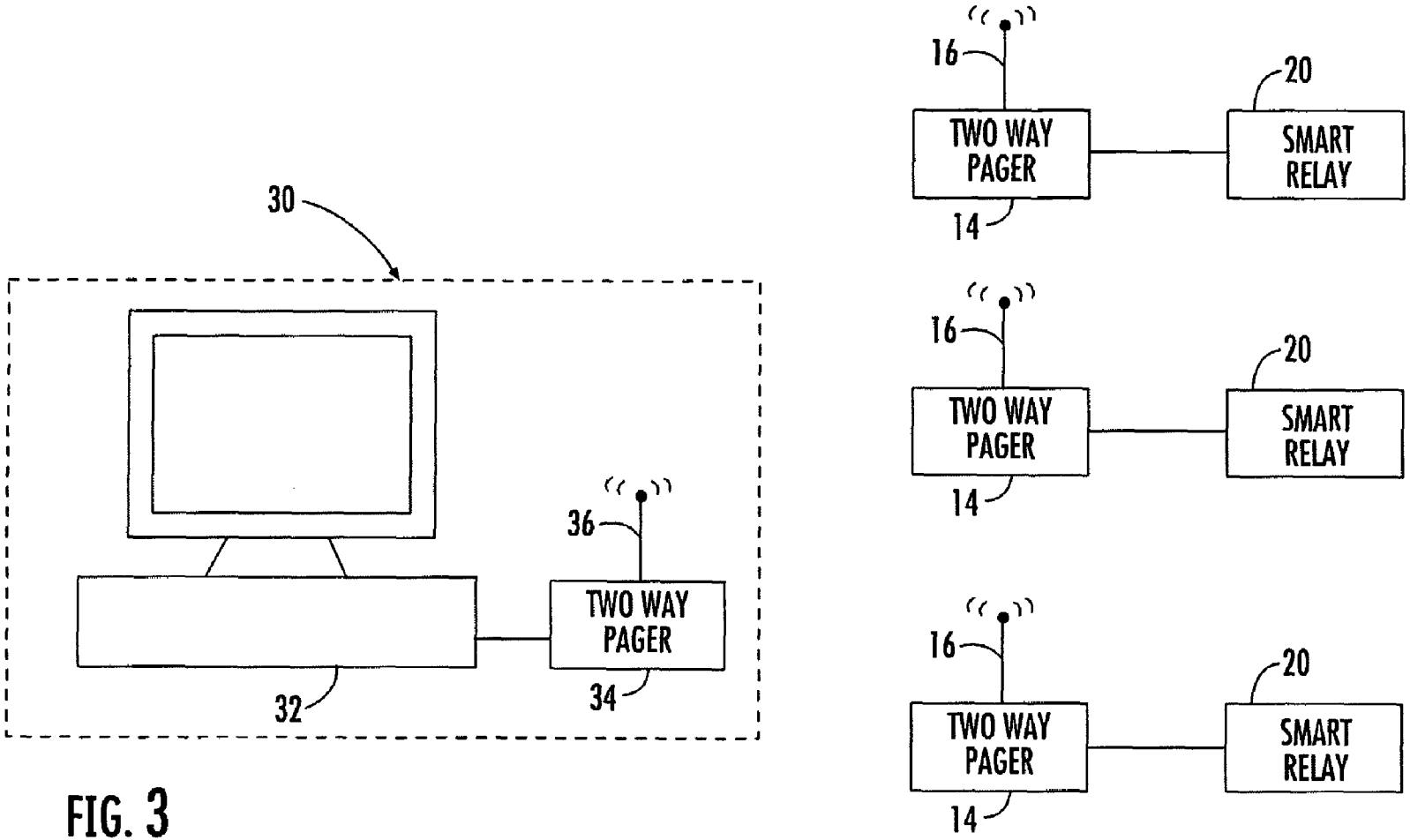
FIG. 3 is a block diagram of an alternative embodiment of the instant invention.

Referring to FIG. 3, an alternative embodiment of the security, telemetry and control system is illustrated wherein the two-way pager 14 is incorporated into the smart relay 20. This configuration allows the base station 30 to send and receive information directly from the smart relay 20 and return commands directly to the smart relay 20. In this manner the mobile piece of equipment can be monitored and controlled from the base station 30 without the MCU 12. This alternative embodiment system may also be configured to require the equipment user to call or page the base station 30 and request for the equipment to be enabled before use. The base station 30 could then enable all or portions of the equipment utilizing the two-way pager devices 34 and 14.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A wireless security, telemetry and control system for a mobile piece of equipment comprising:

at least one smart relay unit associated with a selected function of said mobile piece of equipment, said at least one smart relay unit having a means for receiving wireless communication from a main control unit;

a main control unit located within said piece of equipment having a means for transmitting wireless communication to said at least one smart relay, said main control unit also having a means of establishing a user ID;

wherein said means for establishing a user ID includes at least one electronic key, said electronic key constructed and arranged for electrical communication with an electronic key receiver, said electronic key receiver secured within said mobile piece of equipment and in electrical communication with said main control unit;

whereby said main control unit establishes said user ID and thereafter sends a wireless communication to said smart relay to enable or disable said function of said mobile piece of equipment to which it is associated.

2. The wireless security, telemetry and control system of claim 1 wherein means for transmitting wireless communication from said main control unit to said at least one smart relay unit includes a radio frequency transmitter.

3. The wireless security, telemetry and control system of claim 1 wherein means for transmitting wireless communication from said main control unit to said at least one smart relay unit includes a low frequency transmitter.

4. The wireless security, telemetry and control system of claim 1 wherein means for transmitting wireless communication from said main control unit to said at least one smart relay unit includes an infra red transmitter.

5. The wireless security, telemetry and control system of claim 1 wherein said smart relay unit includes a means for transmitting wireless communication to said main control unit, and said main control unit includes a means for receiving wireless communication from said smart relay unit.

6. The wireless security, telemetry and control system of claim 5 wherein means for transmitting wireless communication from said at least one smart relay unit to said main control unit includes a radio frequency transmitter.

7. The wireless security, telemetry and control system of claim 5 wherein means for transmitting wireless communication from said at least one smart relay unit to said main control unit includes a low frequency transmitter.

8. The wireless security, telemetry and control system of claim 5 wherein means for transmitting wireless communication from said at least one smart relay unit to said main control unit includes a infra red transmitter.

9. The wireless security, telemetry and control system of claim 5 wherein said main control unit includes a memory for storing said wireless communications received from said smart relay;

wherein said stored communications can be downloaded to a external electronic device in electrical communication with said main control unit.

10. The wireless security, telemetry and control system of claim 1 wherein said electronic key includes a user code in read only memory whereby said user code is programmed into said read only memory via a computer and a writer interface.

11. The wireless security, telemetry and control system of claim 1 wherein said electronic key includes a user code in random access memory whereby said user code is programmed into said random access memory via a computer and a reader-writer interface.

12. The wireless security, telemetry and control system of claim 1 wherein said main control unit includes at least one two-way communication system for transmission of data from said main control unit to a remote base station and transmission of commands from said remote base station to said main control unit.

13. The wireless security, telemetry and control system of claim 12 wherein said two-way communication system is a two-way pager system.

14. The wireless security, telemetry and control system of claim 13 wherein said two-way pager communication system includes ReFlex type communication protocol.

15. The wireless security, telemetry and control system of claim 12 wherein said two-way communication system is a two-way cellular system.

16. The wireless security, telemetry and control system of claim 10 wherein said at least one smart relay includes a basic mode wherein said at least one smart relay has normally open electrical contacts and said function of said mobile piece of equipment to which it is associated will not function until said main control unit transmits a allow function signal to said at least one smart relay.

17. The wireless security, telemetry and control system of claim 5 wherein said at least one smart relay includes a smart mode wherein said at least one smart relay has normally closed electrical contacts and said smart relay unit monitors for attempted use of said function of said mobile piece of equipment to which it is associated, whereby upon an attempted use of said function said smart relay unit transmits a signal to said main control unit if said main control unit transmits an accepted identification back to said smart relay said function is allowed to operate, if said main control unit transmits an unaccepted identification to said smart relay said smart relay is opened thereby preventing said function from operation;

wherein said smart relay mode hides said smart relay from diagnostic equipment and the mobile equipment's on-board computer.

18. The wireless security, telemetry and control system of claim 5 wherein said at least one smart relay includes a sensing mode wherein said relay utilizes at least one analog sensor for monitoring a function of the mobile equipment, converts the sensed analog data to a digital signal and transmits said digital data to the main control unit;

wherein at least one of the following parameters is sensed and data is transmitted to said main control unit; electrical, speed, pressure, temperature, fluid level, fluid flow, load, opening of the trunk, hood, doors, windows, movement of the vehicle or within the vehicle, ultrasonic, microwave and radar motion, vibration, sound discrimination, differential pressure, electrical switches.

19. The wireless security, telemetry and control system of claim 5 wherein said at least one smart relay includes a sensing mode wherein said relay utilizes at least one digital sensor for monitoring a function of the mobile equipment and transmits said sensed digital data to the main control unit;

wherein at least one of the following parameters is sensed and data is transmitted to said main control unit; electrical, speed, pressure, temperature, fluid level, fluid flow, load, opening of the trunk, hood, doors, windows, movement of the vehicle or within the vehicle, ultrasonic, microwave and radar motion, vibration, sound discrimination, differential pressure, electrical switches.

20. A wireless security, telemetry and control system for a mobile piece of equipment comprising:

at least one smart relay unit associated with a selected function of said mobile piece of equipment, said at least one smart relay unit having a means for receiving wireless communication from a main control unit;

wherein said at least one smart relay includes a smart mode wherein said at least one smart relay has normally closed electrical contacts and said smart relay unit monitors for attempted use of said function of said mobile piece of equipment to which it is associated, whereby upon an attempted use of said function said smart relay unit transmits a signal to said main control unit if said main control unit transmits an accepted identification back to said smart relay said function is allowed to operate, if said main control unit transmits an unaccepted identification to said smart relay said smart relay is opened thereby preventing said function from operation and wherein said smart relay mode hides said smart relay from diagnostic equipment and the mobile equipment's on-board computer;

a main control unit located within said piece of equipment having a means for transmitting wireless communication to said at least one smart relay, said main control unit also having a means of establishing a user ID;

wherein said smart relay unit includes a means for transmitting wireless communication to said main control unit, and said main control unit includes a means for receiving wireless communication from said smart relay unit;

whereby said main control unit establishes said user ID and thereafter sends a wireless communication to said smart relay to enable or disable said function of said mobile piece of equipment to which it is associated.

21. The wireless security, telemetry and control system of claim 20 wherein means for transmitting wireless communication from said main control unit to said at least one smart relay unit includes a radio frequency transmitter.

22. The wireless security, telemetry and control system of claim 20 wherein means for transmitting wireless communication from said main control unit to said at least one smart relay unit includes a low frequency transmitter.

23. The wireless security, telemetry and control system of claim 20 wherein means for transmitting wireless communication from said main control unit to said at least one smart relay unit includes an infra red transmitter.

24. The wireless security, telemetry and control system of claim 20 wherein means for transmitting wireless communication from said at least one smart relay unit to said main control unit includes a radio frequency transmitter.

25. The wireless security, telemetry and control system of claim 20 wherein means for transmitting wireless communication from said at least one smart relay unit to said main control unit includes a low frequency transmitter.

26. The wireless security, telemetry and control system of claim 20 wherein means for transmitting wireless communication from said at least one smart relay unit to said main control unit includes a infra red transmitter.

27. The wireless security, telemetry and control system of claim 20 wherein said main control unit includes a memory for storing said wireless communications received from said smart relay;

wherein said stored communications can be downloaded to a external electronic device in electrical communication with said main control unit.

28. The wireless security, telemetry and control system of claim 20 wherein said means for establishing a user ID includes at least one electronic key, said electronic key constructed and arranged for electrical communication with an electronic key receiver, said electronic key receiver secured within said mobile piece of equipment and in electrical communication with said main control unit.

29. The wireless security, telemetry and control system of claim 28 wherein said electronic key includes a user code in read only memory whereby said user code is programmed into said read only memory via a computer and a writer interface.

30. The wireless security, telemetry and control system of claim 28 wherein said electronic key includes a user code in random access memory whereby said user code is programmed into said random access memory via a computer and a reader-writer interface.

31. The wireless security, telemetry and control system of claim 20 wherein said main control unit includes at least one two-way communication system for transmission of data from said main control unit to a remote base station and transmission of commands from said remote base station to said main control unit.

32. The wireless security, telemetry and control system of claim 31 wherein said two-way communication system is a two-way pager system.

33. The wireless security, telemetry and control system of claim 32 wherein said two-way pager communication system includes ReFlex type communication protocol.

34. The wireless security, telemetry and control system of claim 31 wherein said two-way communication system is a two-way cellular system.

35. The wireless security, telemetry and control system of claim 29 wherein said at least one smart relay includes a basic mode wherein said at least one smart relay has normally open electrical contacts and said function of said mobile piece of equipment to which it is associated will not function until said main control unit transmits a allow function signal to said at least one smart relay.

36. The wireless security, telemetry and control system of claim 20 wherein said at least one smart relay includes a sensing mode wherein said relay utilizes at least one analog sensor for monitoring a function of the mobile equipment, converts the sensed analog data to a digital signal and transmits said digital data to the main control unit;

wherein at least one of the following parameters is sensed and data is transmitted to said main control unit; electrical, speed, pressure, temperature, fluid level, fluid flow, load, opening of the trunk, hood, doors, windows, movement of the vehicle or within the vehicle, ultrasonic, microwave and radar motion, vibration, sound discrimination, differential pressure, electrical switches.

37. The wireless security, telemetry and control system of claim 20 wherein said at least one smart relay includes a sensing mode wherein said relay utilizes at least one digital sensor for monitoring a function of the mobile equipment and transmits said sensed digital data to the main control unit;

wherein at least one of the following parameters is sensed and data is transmitted to said main control unit; electrical, speed, pressure, temperature, fluid level, fluid flow, load, opening of the trunk, hood, doors, windows, movement of the vehicle or within the vehicle, ultrasonic, microwave and radar motion, vibration, sound discrimination, differential pressure, electrical switches.

* * * * *